US005381120A

United States Patent [19]

Arnold et al.

[11] Patent Number: 5,381,120

[45] Date of Patent: Jan. 10, 1995

[54] MOLDED CASE CIRCUIT BREAKER THERMAL-MAGNETIC TRIP UNIT

[75] Inventors: David Arnold, Chester; Roger N. Castonguay, Terryville, both of Conn.

[73] Assignee: General Electric Company, New York, N.Y.

[21] Appl. No.: 151,652

[22] Filed: Nov. 15, 1993

[51] Int. Cl.[6] ..... H01H 75/12

[52] U.S. Cl. ..... 335/35; 335/42

[58] Field of Search ..... 335/21-23, 335/35, 36, 38, 39, 40, 41, 42

[56] References Cited

U.S. PATENT DOCUMENTS

| | | | |
|---|---|---|---|
| 3,264,435 | 8/1966 | Klein et al. | 335/35 |
| 4,616,199 | 10/1986 | Oster | 335/35 |
| 4,679,016 | 7/1987 | Ciarcia et al. . | |
| 4,725,800 | 2/1988 | Grunert et al. | 335/35 |
| 4,736,174 | 4/1988 | Castonguay et al. . | |
| 5,250,918 | 10/1993 | Edds et al. | 335/35 |

*Primary Examiner*—Lincoln Donovan

*Attorney, Agent, or Firm*—Richard A. Menelly

[57] ABSTRACT

A molded case circuit breaker having a thermal-magnetic trip unit is provided with a mechanical rating plug to allow a number of circuit breakers of different ampere ratings to be used within a common-sized enclosure. The rating plug interacts with a thermal-magnetic trip unit to set the circuit breaker ampere rating.

9 Claims, 6 Drawing Sheets

10

MOLDED CASE CIRCUIT BREAKER THERMAL-MAGNETIC TRIP UNIT

BACKGROUND OF THE INVENTION

The advent of electronic tip units allows the use of an electronic rating plug to set the circuit breaker ampere rating within a common-sized industrial-rated circuit breaker enclosure. Wherein earlier circuit breakers employing thermal-magnetic trip units were designed to meet the various circuit breaker ampere ratings by conforming the size of the circuit breaker components and the circuit breaker enclosure, a large variety of such circuit breakers were stored at the distribution site to meet the electrical distribution market requirements. U.S. Pat. No. 4,649,455 entitled "Rating Plug for Molded Case Circuit Breaker" describes one example of the use of an electronic rating plug to set the circuit breaker ampere rating.

U.S. Pat. No. 4,679,016 describes an industrial-rated circuit breaker design that is economically assembled in an automated process. The circuit breaker utilizes a thermal-magnetic trip unit to interrupt circuit current under overcurrent conditions within a protected circuit. To accommodate the various circuit breaker ampere rating requirements, the circuit breaker entails several sizes. It would be economically advantageous to use a common-sized enclosure with such a circuit breaker employing a thermal-magnetic trip unit in view of the lower cost with the thermal-magnetic trip unit per se.

The circuit breaker ampere rating is defined as the circuit current in amperes that the circuit breaker will continuously transfer without interrupting the circuit. The overcurrent interruption parameters are determined by the thermal-magnetic trip unit contained within the circuit breaker enclosure. Whereas the so-called "long time" and "short time" overcurrent circuit interruption is determined by the thermally-responsive element within the thermal-magnetic trip unit, the "instantaneous" circuit interruption is determined by the magnetic components therein. Earlier attempts to commercialize a thermal-magnetic circuit breaker having a mechanical rating plug have been hampered by the difficulties associated with maintaining the instantaneous circuit interruption response for the different ampere ratings. U.S. patent application Ser. No. 08-48,240 filed Nov. 8, 1993 entitled: "Mechanical Rating Plug for Thermal-magnetic Circuit Breakers" describes the operation of the thermally-responsive element within the circuit breaker to interrupt circuit current upon the occurrence of an overcurrent condition and the interaction between the mechanical rating plug and the thermally-responsive element to set the ampere rating.

Accordingly, one purpose of the instant invention is to provide a thermal-magnet trip unit for circuit breakers employing a mechanical rating plug within a common enclosure which duplicate the same thermal and magnetic response to overcurrent conditions as circuit breakers having enclosure that are sized to meet the different ampere ratings.

SUMMARY OF THE INVENTION

A molded case circuit breaker thermal-magnetic trip unit is adapted to respond to a mechanical rating plug that sets the travel distance between the operating mechanism trip initiating bar and the bimetal associated with the thermal-magnetic trip unit. The travel distance is calibrated to correspond to a specific circuit breaker steady state ampere rating. The magnetic components are adjusted to respond to instantaneous overcurrent circuit conditions.

DESCRIPTION OF THE PREFERRED EMBODIMENT

Figure 1:
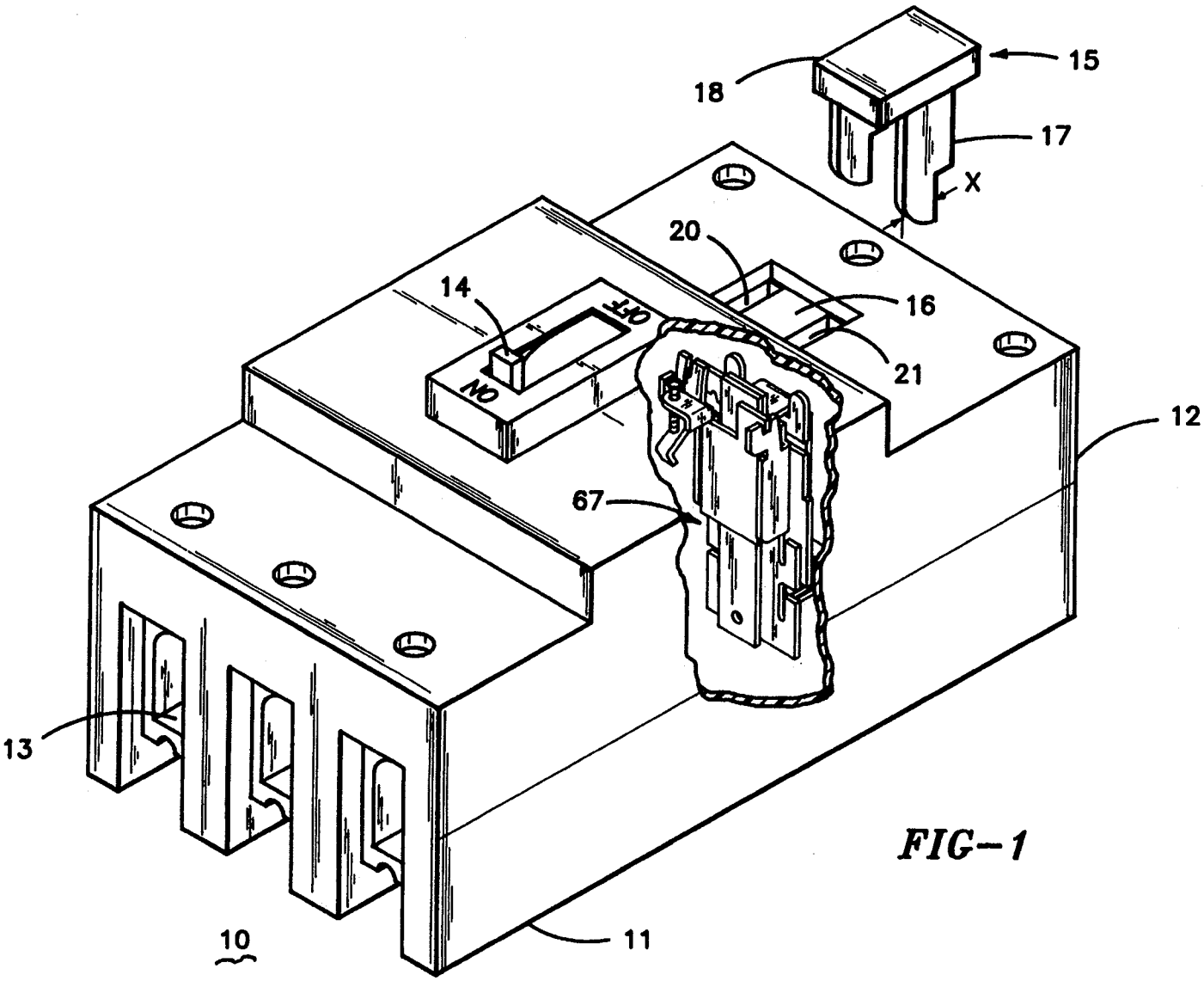
FIG. 1 is a top perspective view of a molded case circuit breaker utilizing a thermal-magnetic trip unit with a mechanical rating plug shown in isometric projection.

An industrial-rated circuit breaker 10 utilizing a thermal-magnetic trip unit is depicted in FIG. 1 and consists of a case 11 to which a cover 12 is attached. A circuit breaker operating handle 14 extends through a slot formed within the circuit breaker cover for manual intervention to turn the circuit breaker to its ON and OFF conditions. The circuit breaker is electrically connected within a protected circuit by means of the line lugs 13 arranged at the line end of the circuit breaker. Although not shown, A similar arrangement of load lugs are arranged at the opposite load end of the circuit breaker. The mechanical rating plug 15 allows a single circuit breaker design to be used over a wide range of ampere ratings. The rating plug includes a top insulative rectangular block 18 with a pair of spaced extensions or legs 17 from a bottom. As will be described below, the width x defining the legs 17 are predetermined to set the ampere rating of the thermal-magnetic trip unit contained within the circuit breaker case. The rating plug is inserted within the recess 16 formed in the cover whereby the legs extend downwards within the corresponding slots 20, 21.

Figure 2:
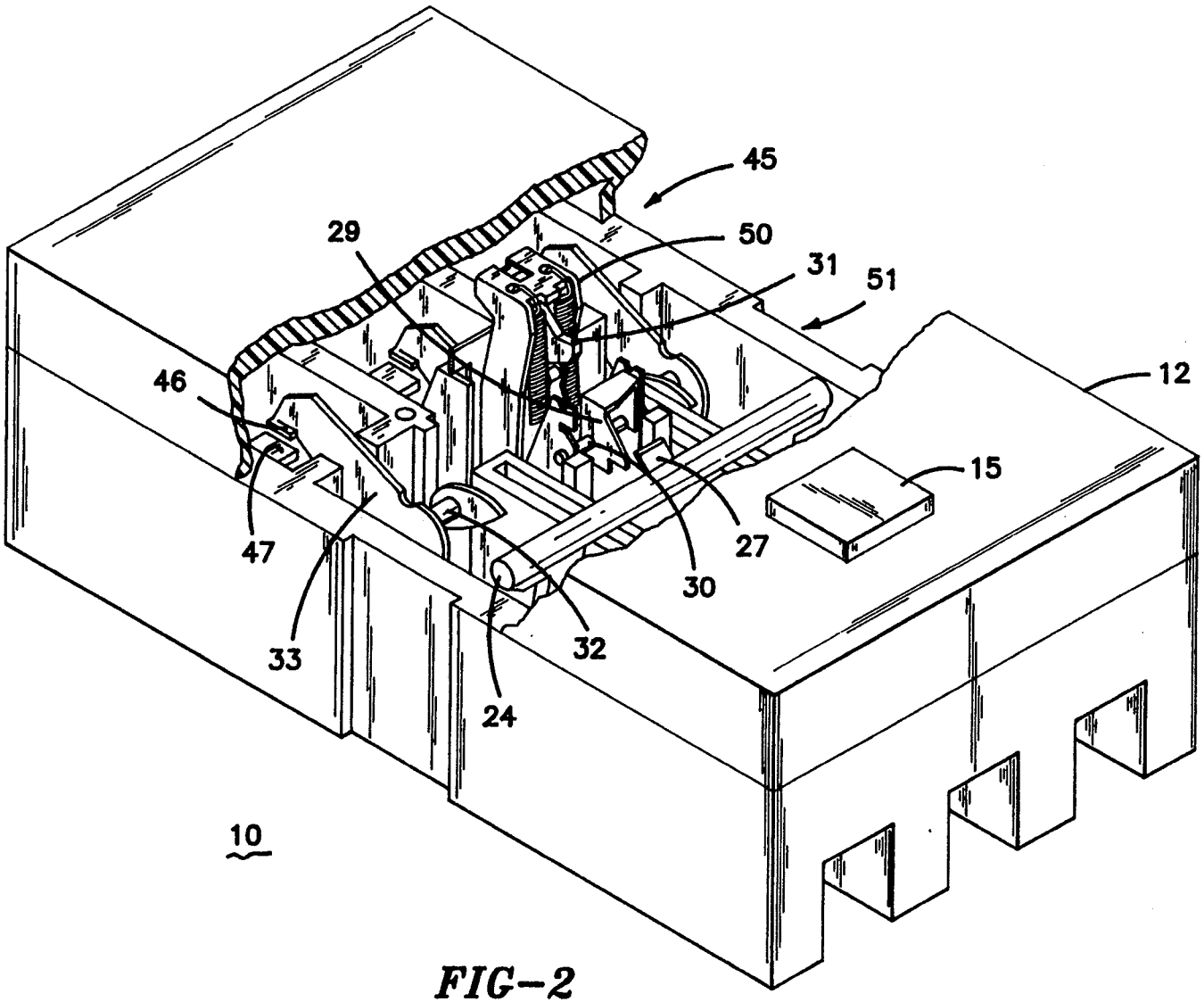
FIG. 2 is a top perspective view of the molded case circuit breaker of FIG. 1 with the cover partially removed to depict the circuit breaker operating mechanism, trip bar assembly and associated contact arms.

The thermal-magnetic trip unit 67 interacts with the circuit breaker operating mechanism 45 to separate the circuit breaker movable and fixed contacts 46, 47 depicted in FIG. 2. The operating mechanism is similar to that described within U.S. Pat. No. 4,736,174 entitled "Molded Case Circuit Breaker Operating Mechanism." The movable contacts 46 are arranged at the ends of corresponding movable contact arms 33 which operate off the insulative crossbar assembly 32. The latching arrangement indicated at 51 includes a latch 29 which is rotatable about a pivot 30 and which restrains the cradle 31 from rotation under the urgency of the powerful operating springs 50 to drive the movable contact arms 33 and the movable contacts 46 out of circuit with the fixed contacts 47. The trip bar 24 is shown in the "tripped" position with the latch plate 27, extending from the top of the trip bar, out from under the latch 29 and the movable contact arms 33 rotated to their open positions. The rating plug 15 inserted within the cover 12 interacts with the trip bar 24 in the manner described within the aforementioned U.S. patent application entitled: "Mechanical Rating Plug Thermal-magnetic Circuit Breakers". The thermal-magnetic trip unit 67 that interacts to articulate the operating mechanism 45 is assembled in the manner best seen by referring sequentially to the following FIGS. 3A–5B.

Figure 3A:
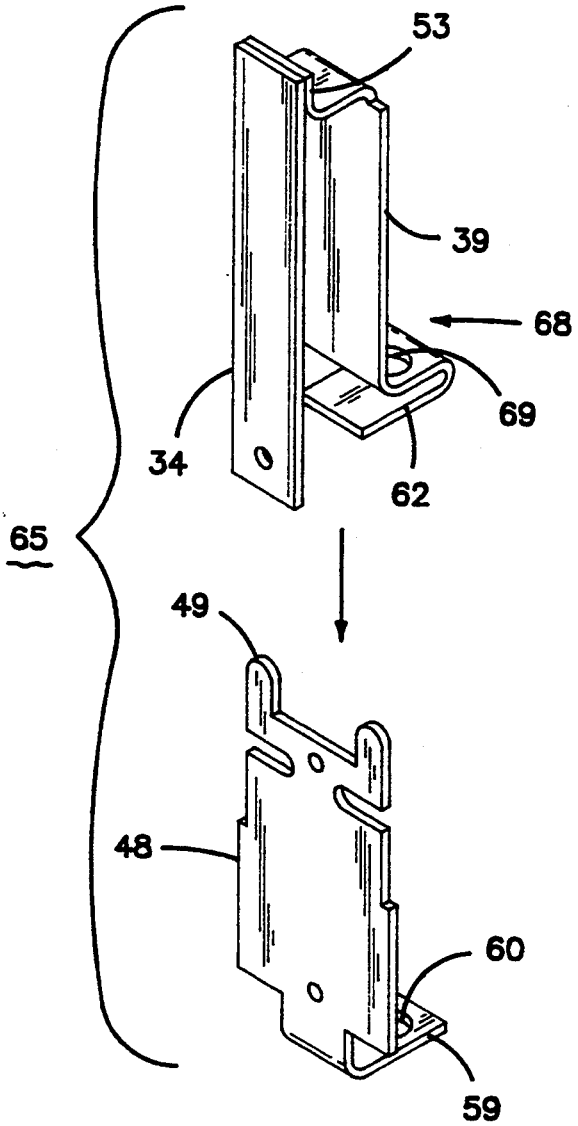
FIG. 3A is a top perspective view of the bimetal assembly prior to attaching to a support plate to form the thermal trip unit sub-assembly.
Figure 3B:
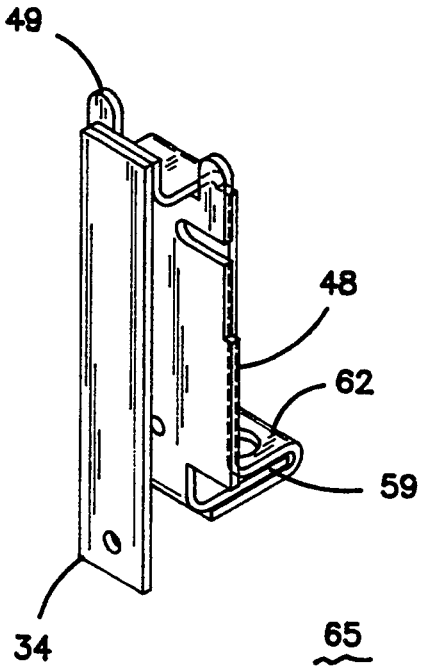
FIG. 3B is a top perspective view of the thermal trip unit subassembly of FIG. 3A.
Figure 6:
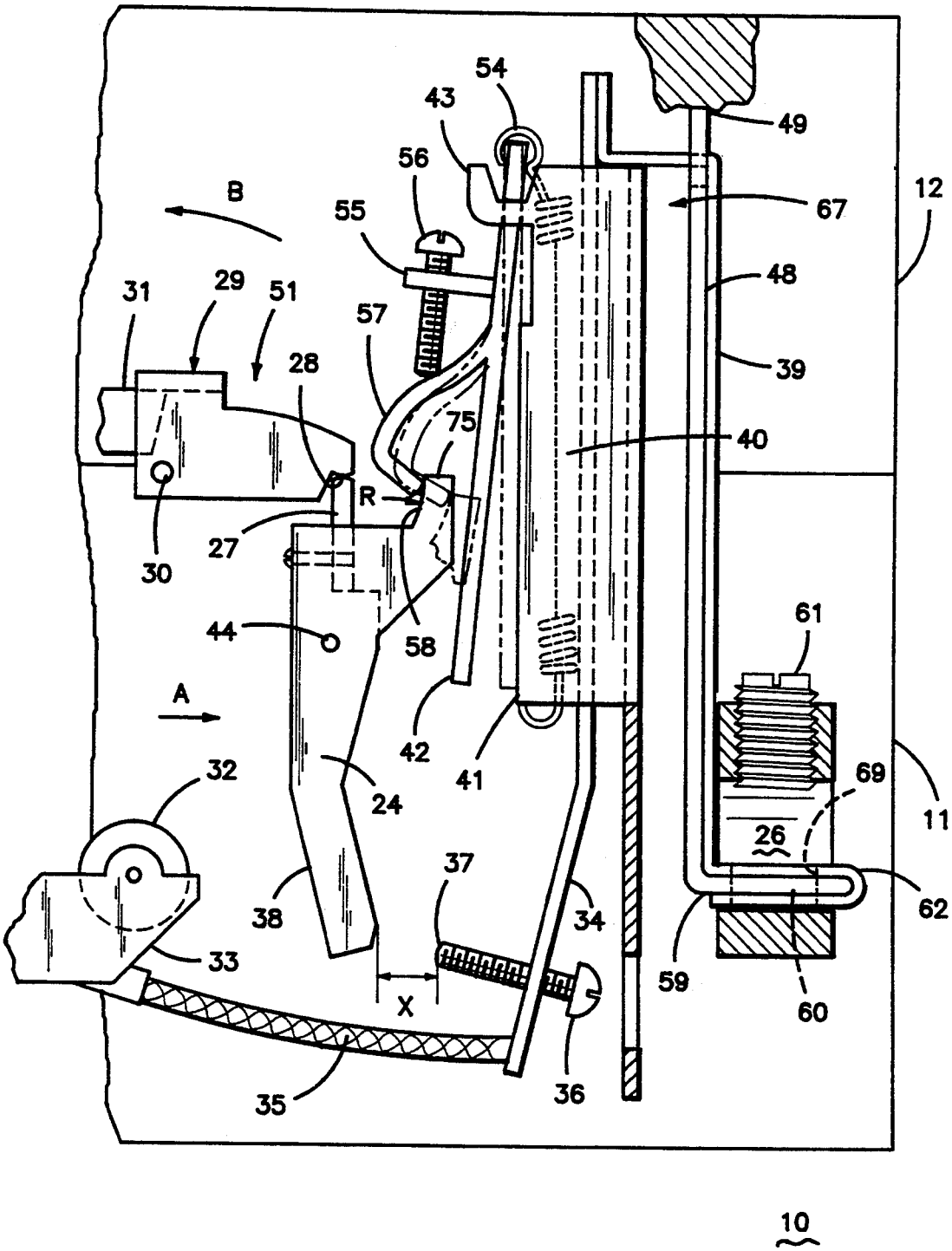
FIG. 6 is a side and partial view of the thermal-magnetic trip unit interacting with the operating mechanism.

In FIG. 3A, the bimetal assembly 68 consisting of the load strap 39 with folded end 62 at the bottom and with the top welded to the bimetal 34 as indicated at 53, is attached to the support plate 48 by positioning the welded end 53 between the support tabs 49 and inserting the screw retainer tab 59 within the folded end. The aperture 69 in the folded end aligns with the aperture 60 in the screw retainer tab so that when the load terminal screw 61 (FIG. 6) is later inserted within the apertures, the support plate is fixedly secured to the bimetal assembly. The thermal trip assembly 65 is shown in FIG. 3B with the top of the bimetal 34 arranged between the support tabs 49 and with the support plate 48 tightly held against load strap 39 by the insertion of the screw retainer tab 59 within the folded end 62.

Figure 4A:
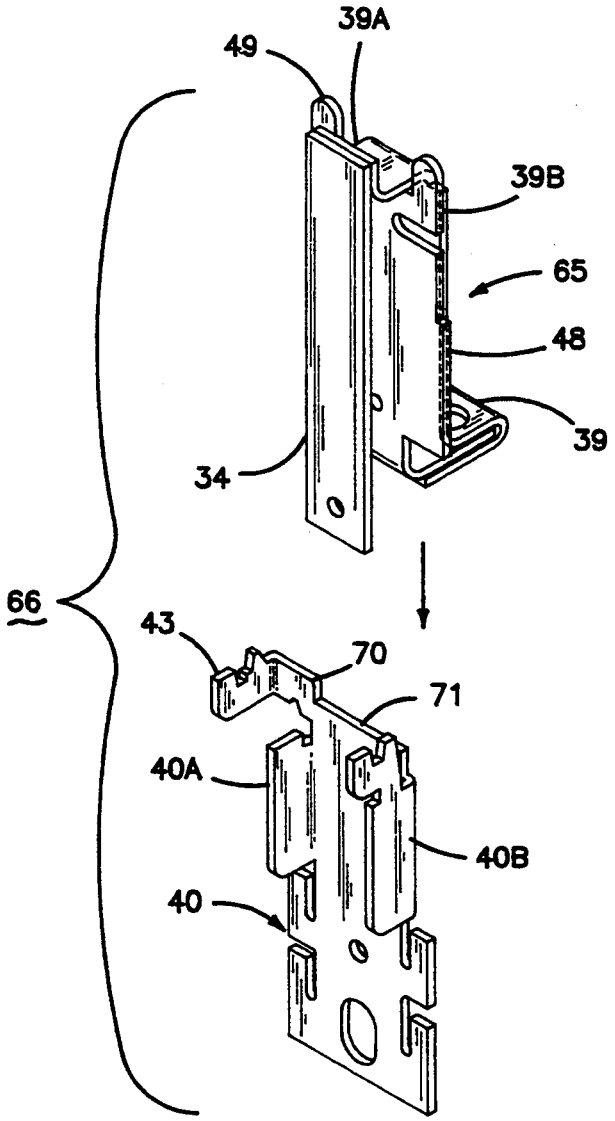
FIG. 4A is a top perspective view of the thermal trip unit subassembly of FIG. 3A prior to attaching to the magnet to form the magnetic trip unit subassembly.
Figure 4B:
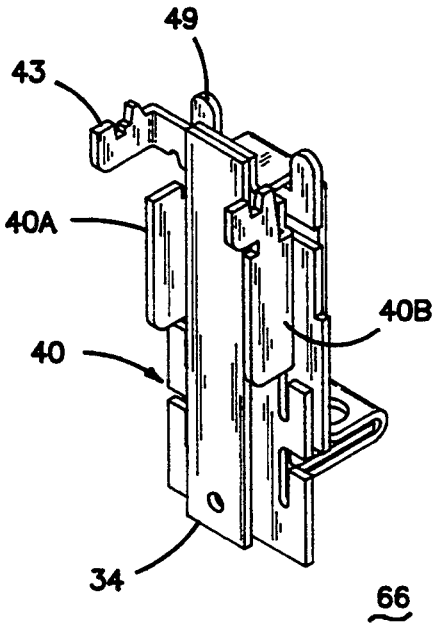
FIG. 4B is a top perspective view of the magnetic trip unit subassembly of FIG. 4A

The thermal trip assembly 65 shown in FIG. 4A is positioned over the magnet 40 and is assembled on the magnet by positioning the bimetal 34 on the front of the magnet and the support plate 48 on the rear of the magnet. The bimetal is precisely aligned between the sidearms 40A, 40B by contacting an edge 39A of the load strap 39 against the protrusion 70 on the top of the magnet and arranging the inner surface 39B of the top of the load strap on the top edge 71 of the top of the magnet. support tabs 49 upstanding from the top of the support plate then become positioned between the support tabs 43 upstanding from the top of the magnet. The positioning of the bimetal 34 on the front of the magnet 40 between the sidearms 40A, 40B and the location of the support tabs 49 inboard the support tabs 43 is shown on the completed magnetic trip assembly 66 in FIG. 4B.

Figure 5A:
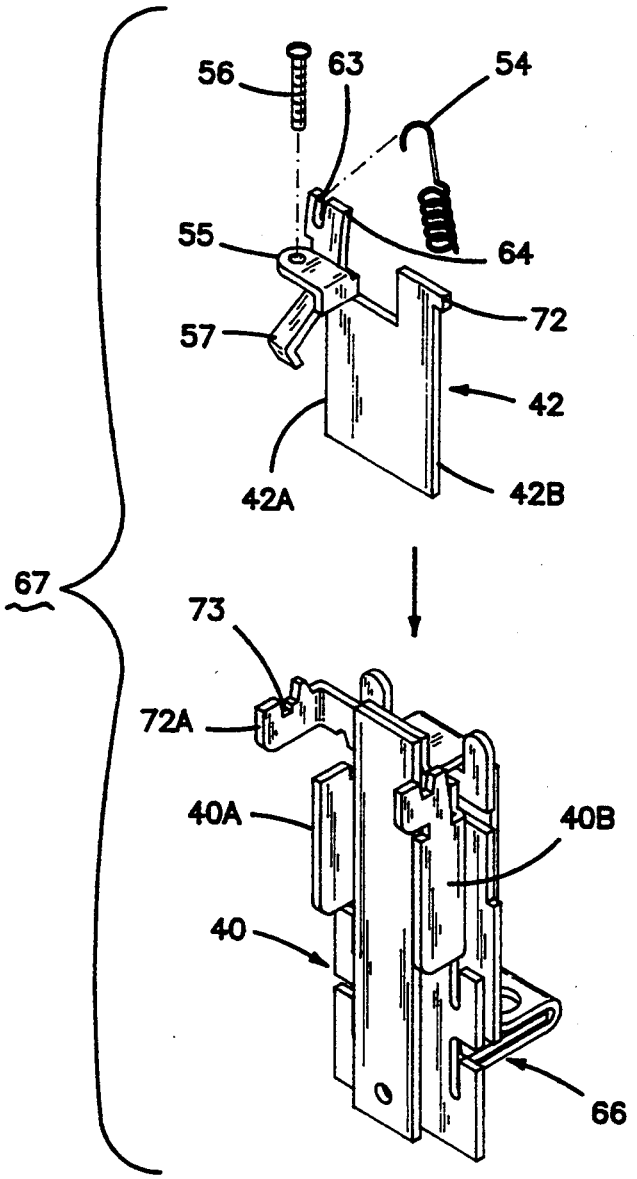
FIG. 5A is a top perspective view of the thermal trip assembly prior to attaching the magnetic armature to form the complete thermal-magnetic trip unit.
Figure 5B:
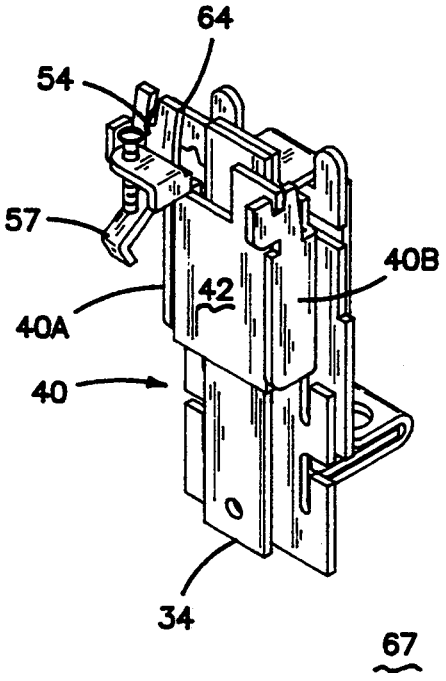
FIG. 5B is a top perspective view of the complete thermal-magnetic trip unit of Figure 5A.

The final assembly of the thermal-magnet trip unit 67 is best seen by referring now to FIGS. 5A, 5B. The armature 42 is positioned over the magnetic trip assembly 66 and is assembled on the top of the magnetic trip assembly by capturing the tabs 72 extending from opposite ends of the top of the armature within the slots 73 formed within the support tabs 72A on the top of the magnet 40. The edges 42A, 42B of the armature then become aligned with the edges of the sidearms 40A, 40B as shown in FIG. 5B. The extension bias spring 54 is positioned on the top of the armature 42 by capturing the top of the spring within the spring slot 63 formed within the upstanding tab 64 on the top of the armature. The calibration screw 56 is threadingly inserted within the aperture 55 in the angulated trip tab 57 formed on the top of the armature. When inserted within the aperture, the end of the screw contacts the trip tab 57 to provide magnetic trip calibration as will be discussed below in some detail with reference to the programmable circuit breaker 10 depicted in FIG. 6. The cradle 31 is depicted trapped under the U-shaped latch 29 which latch is restrained from rotation about the pivot 30 by the positioning of the latch plate 27 under the latch slot 28. When the latch plate is translated in the direction indicated by arrow A, the cradle 31 rotates in the direction indicated by arrow B to allow the rotation of the movable contact arm 33 and the associated crossbar 32 as described earlier. Electric circuit between the bimetal 34 and the movable contact arm 33 is provided by the braid conductor 35, as indicated. The movement of the trip bar 24 to which the latch plate 27 is fixedly secured, is governed by the leg 38 extending from the bottom of the trip bar and arranged for impact by the end 37 of the calibration screw 36 that is inserted through the bimetal 34. When the current through the bimetal is sufficient to displace the bimetal against the leg 38 of the trip bar 24, the trip bar translates in the direction of the arrow A described earlier, and displaces the latch plate 27 out from under the latch slot 28 to articulate the operating mechanism. As described in the aforementioned U.S. patent application, the rating plug 15, (FIG. 1) sets the separation distance x between the end 37 of the calibration screw and the leg 38 of the trip bar 24 for the ampere rating of the circuit breaker. The higher ratings correspond to the larger separation distances which are predetermined by the manufacturer and are calibrated to the user's specification by means of the adjustment screw 36. The thermal-magnetic trip unit 67 according to the invention is inserted within the circuit breaker case 11 and cover 12 and is secured to the load lug 26 by means of the load terminal screw 61. The support tabs 49 on the top of the support plate 48 are forced downward by interference with the bottom surface of the cover to automatically correct for any tolerances accumulated within the thermal-magnetic trip unit 67. The openings 69, 60 within the load strap 39 and the screw retainer tab 59 on the support plate 48 align with the opening (not shown) under the load lug 26 to receive the load terminal screw 61. The bimetal 34 extends within the magnet 40 to provide a single turn transformer relative to the magnet and concentrates the associate magnetic forces generated at the edges of the magnet sidearms as indicated at 41. The armature 42 is pivotally arranged on the support tabs 43 at the top of the magnet to respond to the magnetic forces and move away from the home position indicated in solid lines to the tripping position against the magnet as indicated in phantom. The bias spring 54 on the top part of the armature holds the armature away from the tab 75 on the top of the trip bar 24. Upon occurrence of a short circuit current, the armature 42 is rapidly driven toward the magnet 40 carrying the trip tab 57 lanced from the top of the armature into contact with the tab 75, rotating the trip bar about the pivot and moving the latch plate 27 out from the latching slot 28 to allow the cradle 31 to rotate away from the latching arrangement 51 and allow the operating mechanism to motivate the movable contact arm 33. To calibrate the short circuit response of the magnet 40, the magnetic calibration screw 56 extending through the calibration tab 55 is driven downward against the trip tab 57 to the position indicated in phantom to release the latch plate 27 when a predetermined multiple of the rated current is established through the bimetal under test conditions. To insure a constant magnet trip force for every ampere rating upon calibration, the inner surface 58 of the trip tab 75 is formed to a predetermined radius R. The maintenance of the common tripping force relative to the latching arrangement 51 is an important feature of the invention since it allows the common thermal-magnetic trip unit 67 to be used over a wide range of circuit breaker ratings without having to modify the operating mechanism 45 (FIG. 2).

The invention accordingly allows industrial-rated circuit breaker ampere ratings to be provided within a common circuit breaker enclosure having common operating components by means of a mechanical rating plug and thermal-magnetic trip unit assembly. Large numbers of the common enclosures are stocked at the point of distribution along with corresponding rating plugs in lieu of different-sized circuit breaker enclosures for each of the various ampere ratings.

We claim:

1. A thermal-magnetic trip unit for molded case circuit breakers comprising:

a load strap having means for attachment to a circuit breaker load terminal at one end and joined to a bimetal element at an opposite end;

a support plate arranged on said load strap intermediate said bimetal and said attachment means;

a magnet having support tabs extending from a top thereof and magnetic means extending from a front for concentrating magnet forces in a forward direction;

an armature on said support tabs and arranged for rotation toward said magnetic means upon transport of overcurrent through said bimetal;

means on said armature biasing said armature away from said magnetic means during transport of quiescent current through said bimetal, said biasing means comprises a spring arranged on a slotted tab extending from a top of said armature;

a trip tab projecting from said armature and arranged for contacting a circuit breaker trip bar; and a calibration tab extending from said top of said armature and a calibration screw extending through said calibration tab, an end of said screw contacting a part of said trip tab for setting overcurrent response to said armature.

2. A molded case circuit breaker having a thermal-magnetic trip unit comprising:

a molded plastic case and cover;

an operating mechanism in said case arranged for rotating a movable contact arm to an open position upon occurrence of an overcurrent condition within a protected circuit, a cradle within said operating mechanism and engaging a latch for restraining said operating mechanism under quiescent current conditions through a protected circuit, said latch including a latching slot and said trip bar includes an upwardly extending latching plate arranged under said latching slot;

a thermal-magnetic trip unit within said case arranged for electrical connection with a protected circuit and responding to an overcurrent condition, said trip unit including a bimetal responsive to an overcurrent conditions of a first magnitude and an armature responsive to a second overcurrent condition of a magnitude greater than said first magnitude, said trip unit further including a trip tab lanced outward from said armature and arranged for contacting said circuit breaker trip bar, a calibration tab extending from a top of said armature and a calibration screw extending through said calibration tab, an end of said screw contacting a part of said trip tab for setting overcurrent response to said armature; and a trip bar interacting between said trip unit and said latch, said trip bar releasing said latch from said cradle upon contact by said bimetal or said armature, said trip bar including a top extension interacting with said armature and a bottom extension interacting with said bimetal.

3. The molded case circuit breaker of claim 2 wherein said trip unit includes a load strap having means for attachment to a circuit breaker load terminal at one end and joined to a bimetal element at an opposite end.

4. The molded case circuit breaker of claim 3 wherein said trip unit includes a support plate arranged on said load strap intermediate said bimetal and said attachment means.

5. The molded case circuit breaker of claim 3 wherein said trip unit further includes a magnet having support tabs extending from a top thereof and magnet means extending from a front for concentrating magnet forces in a forward direction.

6. The molded case circuit breaker of claim 3 wherein said trip unit includes means on said armature biasing said armature away from said magnetic means during transport of quiescent current through said bimetal.

7. The molded case circuit breaker of claim 3 including a trip tab projecting from said armature and arranged for contacting a circuit breaker trip bar.

8. The molded case circuit breaker of claim 3 wherein said trip tab is lanced outward from said armature.

9. The molded case circuit breaker of claim 3 wherein said biasing means comprises a spring arranged on a slotted tab extending from a top of said armature.

* * * * *